United States Patent [19]

Shankel et al.

[11] 3,961,792

[45] June 8, 1976

[54] APERTURED PADDLE AND RESILIENT PROJECTILE

[75] Inventors: John Shankel; Marilou Shankel, both of San Francisco, Calif.

[73] Assignee: Lawrence Peska Associates, Inc., New York, N.Y. ; a part interest

[22] Filed: Mar. 27, 1975

[21] Appl. No.: 562,469

[52] U.S. Cl. ..... 273/95 R; 46/74 D; 273/106 B; 273/105 R; 273/67 R

[51] Int. Cl.[2] ..... A63B 71/00

[58] Field of Search ..... 46/74 R, 74 D, 75; 273/95 R, 96 R, 106 R, 106 B, 67 R, 73 R

[56] References Cited

UNITED STATES PATENTS

| | | | |
|---|---|---|---|
| 2,480,264 | 8/1949 | Regenold | 273/96 R |
| 3,009,701 | 11/1961 | Goldfarb | 273/106 B |
| 3,091,460 | 5/1963 | Maldonado | 273/96 R |
| 3,231,271 | 1/1966 | Murphy | 273/73 R |
| 3,366,386 | 1/1968 | Lindholm | 273/67 R |
| 3,805,941 | 4/1974 | Gattaneo | 197/53 |

*Primary Examiner*—Richard C. Pinkham
*Assistant Examiner*—Marvin Siskind

[57] ABSTRACT

There is disclosed a toy comprising a resilient member having radially extending cuts therein, said cut defining a substantially spherical solid central core. There is further disclosed a paddle having a handle at one end thereof and a circular, apertured portion at the second end. The aperture is of a dimension greater than the dimension of the resilient member.

5 Claims, 4 Drawing Figures

APERTURED PADDLE AND RESILIENT PROJECTILE

BACKGROUND OF THE INVENTION

This invention relates to a toy or game apparatus which may be played by an individual alone or by a group of persons; age is not a factor in playing the game. Children who are coordinated are able to play the game. More particularly, the invention relates to a game that lends itself to many faceted areas of activity. It is a challenge to many ages and abilities. Small children can use it as a safe indoor or outdoor diversion. Older children and adults can use it as a game of dexterity and skill.

It is accordingly an object of the present invention to provide for a toy and game apparatus, which broadly speaking includes the provision of a toy comprising a resiliant member having radially extending cuts therein, said cuts defining a substantially spherical solid central core.

Another object of the invention of the character set forth above which is that it is simple and inexpensive to construct, and may be utilized by an individual person as well as by two or more persons as a game played in combination and competition with one another.

These and other objects of the invention will become more apparent from the following detailed disclosure and claims and from the accompanying drawings in which:

Figure 1:
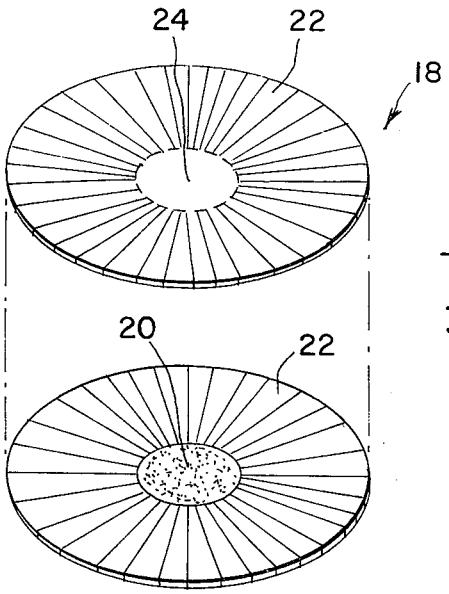
FIG. 1 is a side elevational view of an exploded segment of the invention.
Figure 2:
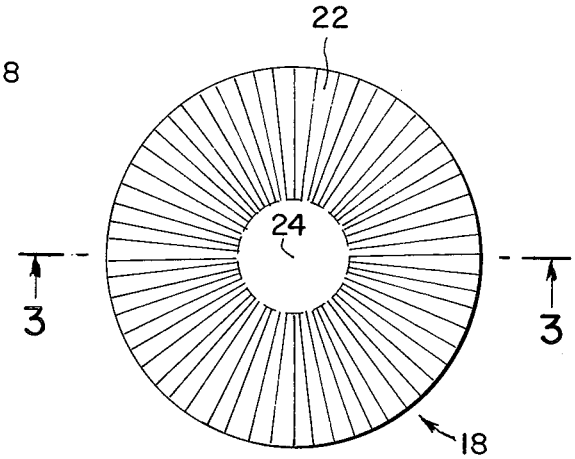
FIG. 2 is a top plan view of FIG. 1.
Figure 3:
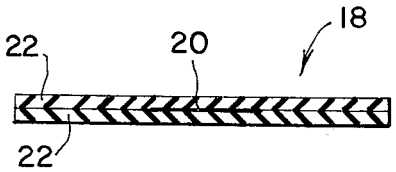
FIG. 3 is a cross section taken along the line 3—3 of FIG. 2.
Figure 4:
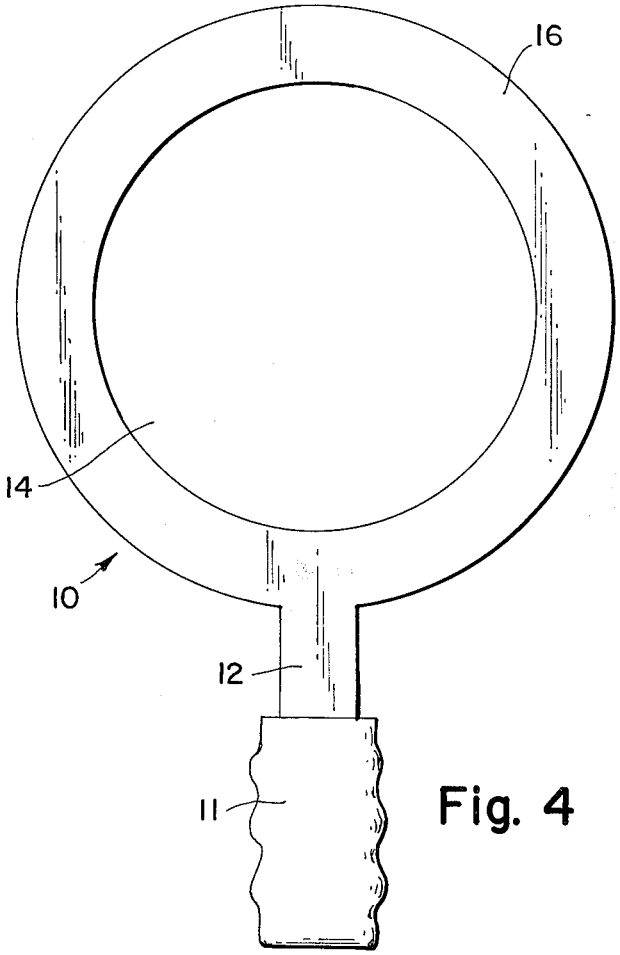
FIG. 4 is a top plan view of the handle portion of the invention.

As shown in the drawings, the invention includes a paddle 10 having a gripping portion 12 preferably with additional gripping means 11 thereon. The paddle 10 will define an aperture, preferably a substantially spherically opened area 14 bordered by a circumferential portion 16 defining the same. The paddle 10 may be of unitary construction, i.e., the handle portion 12 and the circumferential portion 16 being integral, or the handle portion 12 may be attached by any suitable attachment means, such as adhesion, screws, etc. to the circumferential portion 16. The paddle 10 may be constructed out of any suitable light weight material, such as plastic, light weight wood, stiff rubber, light weight metal or the like. The member shown in FIGS. 2–3 is that portion of the invention which is the moving member. For the purpose of discussion it is called a resiliant member 18. This member 18 will generally be constructed of any light weight resiliant (rubber) or elastomeric material, i.e., latex or the like. It may be of unitary construction as depicted in FIG. 2 or be comprised of two like members that are adhered at the substantial centers 20 thereof one to the other. The resiliant member will define around its periphery a series of cuts 22. These may be symetrical and regular or asymetrical and irregular. These cuts 22 may be made in the member 18 by simply cutting the same from the outer edges thereof in a radially inward direction towards an imaginary inner circle such that there is formed a series of radii, which radii will define at substantially centered point 24 another circle, which point, however, is not cut. The cuts which form the strips 22 are of a length of approximately one or two inches, preferably 1½ to 1¾ inches, though the length thereof is substantially non-critical. Greater or lesser lengths being compensated for by adjusting the various other dimensions of the parts of the invention. The strips will be approximately ¼ to ¾ inches in width. The overall diameter of the member can vary but it is preferred that the same be approximately four to 6 inches, most preferrably about 5 inches. The paddle 10 portion will define an opening approximately 1 inch larger in diameter than the diameter of the member 18. The length of the handle portion 12 can vary, but it is preferred that the same be about four to 6 inches. The handle portion 12 can be of any shape, round, square, etc., as may be the side portions of the portion 16 defining the circumferential area.

The device lends itself to many activities and can be played with or without the paddle portion 10, as described hereinbelow.

Individual activities without the paddle 10

Some of these suggested activities are more challenging than others.

1 Bounce the member 18 up and down on palm or back of hand.

2 Bounce the member 18 up and down on the instep of the foot.

3 Bounce the member 18 from hand to hand or from hand to foot or vice versa.

4 Bounce the member 18 high, turn around and catch it for the next bounce.

5 Bounce the member 18 on hands and clap — once, twice — as many times as you can between bounces.

6 Chant rhymes in time while bouncing the member 18.

Group activities without the paddle 10

1 Pass the member 18 back and forth as in volley ball.

2 Pass the member 18 around in a circle and chant rhymes.

Individual activities with the paddle 10

1 Pass paddle 10 horizontally through the member 18 as it bounces up and down on hand or foot.

2 Bounce the member 18 in air and try to make it fall through the paddle 10 held parallel to the ground.

Group activities with the paddle 10

1 One player holds the paddle 10 and the other player tries to throw the member 18 through the paddle 10. The distance between the thrower and the paddle 10 may be increased after each successful throw until a throw is missed. Then the players reverse roles. The player who can ring the member 18 from the greatest distance is the winner.

2 One player bounces the member 18 up and down on his hands and the other player tries to pass the paddle 10 through there on a bounce. The person who succeeds in the least amount of attempts is the winner.

As is evident, numerous other modifications and variations of the invention may be adopted. All such modifications and variations in the game procedure as well as in the construction of the toy itself are within the broader scope of the invention.

Having thus described the invention, what we claim as new is:

1. A toy comprising a resilient member having radially extending cuts therein, said cuts defining a substantially circular solid central core in combination with a paddle member having handle means at one end thereof and a substantially centrally located aperture defined by a substantially spherical ring shaped portion at a second end thereof, said aperture being of a dimension greater than the dimension of said resilient member.

2. A toy as defined in claim 1 wherein said resiliant member is comprised of two substantially identical portions adhered to each other.

3. A toy as defined in claim 1 wherein said member defines a substantially circular piece having multiple cuts therethrough, said piece being in one plane.

4. A toy as defined in claim 1 wherein said ring shaped portion and said handle means are of unitary construction.

5. A toy as defined in claim 1 wherein said ring shaped portion is affixed to said handle means.

* * * * *